United States Patent [19]

Meetham et al.

[11] 4,292,010

[45] Sep. 29, 1981

[54] CAMBERED BLADE OR VANE FOR A GAS TURBINE ENGINE

[75] Inventors: Geoffrey W. Meetham, Allestree; John R. Marjoram, Coxbench, both of England

[73] Assignee: Rolls-Royce Limited, London, England

[21] Appl. No.: 68,723

[22] Filed: Aug. 22, 1979

[30] Foreign Application Priority Data

Sep. 16, 1978 [GB] United Kingdom ..... 37112/78

[51] Int. Cl.[3] ..... F01D 5/14

[52] U.S. Cl. ..... 416/241 R; 416/213 R; 416/229 A

[58] Field of Search ..... 416/241 R, 213, 229 A

[56] References Cited

U.S. PATENT DOCUMENTS

| | | | |
|---|---|---|---|
| 3,008,855 | 11/1961 | Swenson | 416/241 R X |
| 3,494,709 | 2/1970 | Piearcey | 416/241 R X |
| 3,900,668 | 8/1975 | Olcott | 416/241 B X |
| 4,164,061 | 8/1979 | Bronovsky et al. | 416/213 R X |
| 4,184,900 | 1/1980 | Erickson et al. | 416/241 R |

FOREIGN PATENT DOCUMENTS

| | | | |
|---|---|---|---|
| 280007 | 4/1952 | Switzerland | 416/241 B |
| 985772 | 3/1965 | United Kingdom | 416/213 R |

*Primary Examiner*—Everette A. Powell, Jr.

*Attorney, Agent, or Firm*—Cushman, Darby & Cushman

[57] ABSTRACT

A blade or vane for a gas turbine has a cambered aerofoil made up of a plurality of single crystals of an alloy. Each crystal extends longitudinally of the aerofoil and has a predetermined three-dimensional orientation different from that of the other crystals such that it has an optimum value of a chosen property in directions longitudinal and transverse of the aerofoil.

11 Claims, 5 Drawing Figures

CAMBERED BLADE OR VANE FOR A GAS TURBINE ENGINE

This invention relates to a cambered blade or vane for a gas turbine engine and a method of making it.

In the production of cast blades or vanes for gas turbine engines the technique of directional solidification has recently been widely accepted as a production method. This technique involves the use of a casting process in which the solidification front progresses in a unidirectional manner through the blade casting. In this way a blade is produced having substantially all the grains extending in one direction. This process is more fully described in various prior patents of which British Pat. No. 1,349,099 (U.S. Pat. No. 3,845,808) is an example.

An extension of this technique is used to produce single crystal blades, in which, as the name implies, the blade or at least the aerofoil of the blade comprises a single crystal of the alloy involved. Such blades may be given overall properties which are an improvement upon those of an equiaxed or even a directionally solidified material.

This is done by the careful exploitation of the anisotropic nature of the crystals of the metal involved. Clearly the main stresses on the aerofoil of a rotor blade will be those caused by centrifugal effects, and will act longitudinally on the aerofoil, while there will also be transverse stresses which occur in a direction transverse to the longitudinal extent of the blade. Similar considerations will apply to a stator blade or vane.

If the crystal is orientated so that one of its directions of optimum properties extends in the longitudinal direction while another lies in the direction of the transverse stress, a strong blade will result. However, in a cambered blade the transverse thermal stress, for instance, will not lie along a straight line but will follow the mid chord line of the blade. It will not, therefore, in general be possible to match the optimum crystal direction to the line of the transverse stress for a cambered blade.

It is of course possible to match these parameters in at least one portion of the blade section. If the angle between the leading and trailing edge portions of the mid chord line approximates to that between two of the optimum crystal directions it is possible to provide the necessary matching at leading and trailing edges. However, even in this special case the mid-section of the aerofoil will have relatively poorer properties. In the more general case, an orientation of a single crystal which produces the correct direction of optimum properties for a particular portion of the cambered aerofoil section will produce relatively poorer properties in the portions of the section.

The present invention provides a blade or vane in which the properties may be optimised better than can be done with the 'single crystal' blade.

According to the present invention a blade or vane for a gas turbine engine has a cambered aerofoil portion comprising a plurality of single crystals of an alloy, each said crystal extending longitudinally of the aerofoil and having pre-determined three-dimensional orientation different from that of the other crystals such that it has an optimum value of a chosen property in directions longitudinal and transverse of the aerofoil.

In one embodiment there are three said crystals.

The single crystals are preferably separately formed and joined together to form the aerofoil shape by a metallurgical bonding process.

The crystals may be formed and their orientation determined by a seeding method or alternatively by the use of tortuous passages which only allow crystals of the required orientation to reach their outlets and to commence solidification in the blade mould.

The invention will now be particularly described, merely by way of example, with reference to the accompanying drawings in which.

Figure 1:
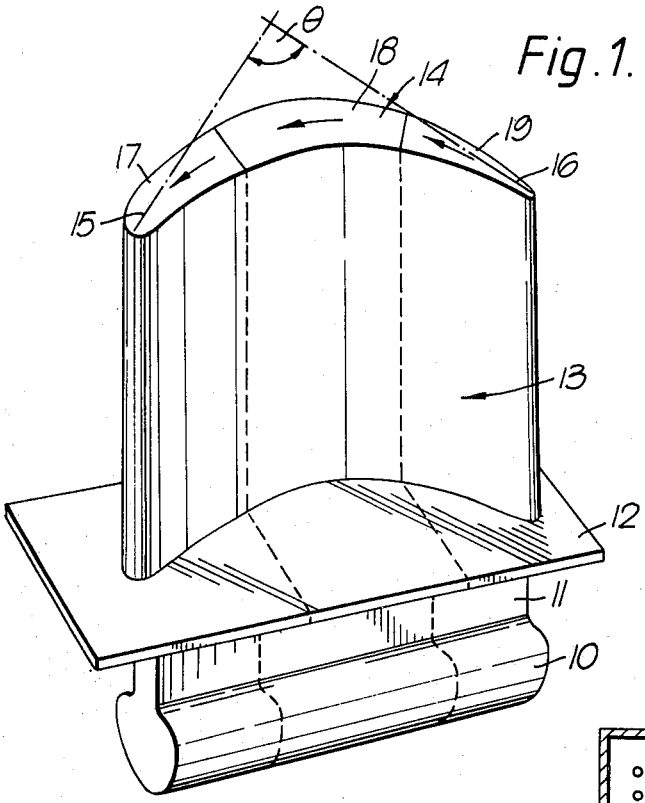
FIG. 1 is a perspective view of a blade in accordance with the invention.

In FIG. 1 there is shown a turbine blade consisting of a root portion 10, a shank 11, a platform 12 and an aerofoil 13. The cross-section of the aerofoil 13 is visible at its tip 14 and it will be seen that the camber of the aerofoil is such that the mid-chord line 15 at its leading edge makes a considerable angle with the mid-chord line 16 at its trailing edge.

It will be appreciated that although some of the stresses on the aerofoil 13, e.g. the centrifugal loads, act on the aerofoil uni-directionally, others do not. In particular in the case of the turbine blade described some thermal stress on the aerofoil acts on each element of the blade in the direction of the mid-chord line. It will also be understood that each single crystal of the superalloy material used to make the blade has anisotropic properties. Thus as an example, in the normal crystal structure (face centred cubic) which applies to superalloys of this sort, the value of Young's modulus is high in the $<1, 1, 1>$ direction, lower in the $<1, 1, 0>$ direction and at its lowest in the $<1, 0, 0>$ direction. It has been found that for blades (e.g. turbine rotor blades) operating under conditions of thermal stress, it is desirable that the modulus in the direction of highest stress should be as low as possible. It will be noted that in the following description of a turbine blade this low modulus property is of major interest, however, in the case of other blades or vanes such as compressor blades the thermal properties may not be of major significance. In such cases it might be desirable to arrange that the direction of high modulus extends longitudinally and transversely of the aerofoil.

It follows therefore that if the aerofoil 13 is made of a single crystal it is possible to orient this crystal to provide the optimum properties (low modulus) in the direction of the centrifugal stresses, but not to provide a similar optimum at all points along the mid-chord line. It is possible that with some alloys and some forms of aerofoil the angle $\theta$ will equal the angle between adjacent $<1, 0, 0>$ directions of the crystal which provide optimum values of the thermal stress resistance (low values of Young's modulus) of the alloy, and in this case the leading and trailing edge regions could well have optimised properties.

However, this is a special case and even then the mid region of the aerofoil will not have the optimum properties. In the aerofoil 13 of FIG. 1 this problem is solved by making the aerofoil of three single crystals 17, 18 and 19. The crystals extend longitudinally to form the leading edge, mid section and trailing edge regions of the aerofoil respectively and are each orientated so that one of their <1, 0, 0> directions are as shown by the arrows in the drawing while another extends longitudinally of the blade. Therefore one of their directions of low Young's modulus and hence optimum thermal properties extends approximately along the mid-chord line of the relevant portion of the blade. As mentioned above we find that the thermal stresses on the blade, as well as being longitudinal, have a significant component which runs along the mid-chord line.

It will be seen that using the three crystals 17, 18 and 19 enables the directions of optimum thermal properties to match very closely the mid-chord line of the aerofoil 13, but obviously if the camber of a blade is more or less than that illustrated it may be preferable to use a greater or lesser number of individual single crystals to match the mid-chord line. Normally, it will be possible to orient the crystal so that the direction of optimum properties is at least parallel with that part of the mid-chord line which passes through the crystal or an adjacent portion if the line does not actually interest the crystal.

In order to manufacture the blade of FIG. 1 a technique in which the separate crystals are separately formed and subsequently joined metallurgically is preferably used, although it would be possible to use an integral casting technique.

Figure 2:
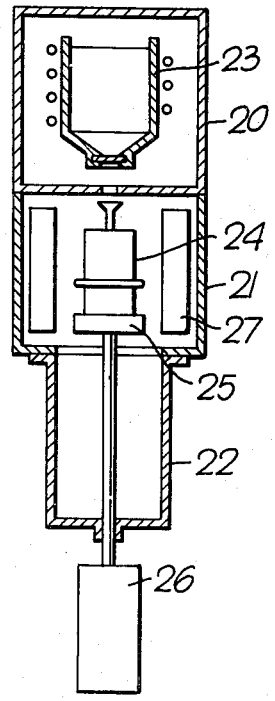
FIG. 2 is a diagrammatic representation of casting apparatus in which the blade of FIG. 1 may be made.

Both methods would involve the use of the apparatus shown in FIG. 2. This apparatus is basically similar to that used to produce directionally solidified castings and is fully described in our British Pat. No. 1,349,099 (U.S. Pat. No. 3,845,808). In essentials the apparatus consists of an upper, charge containing chamber 20, a middle, casting chamber 21, and a lower withdrawal chamber 22. In the upper chamber 20 a bottom pouring induction heated crucible 23 carries the charge of metal for casting, while in the middle chamber 21 a mould 24 is mounted on a chill plate 25. The chill plate 25 is in turn mounted on a ram 26 so that it can be withdrawn from the middle chamber 21 which is provided with heating elements 27 in its wall.

In operation, the three chambers 20, 21 and 22 are evacuated and the crucible 23 heated to melt the charge of metal contained within it. The charge of metal may comprise any of the suitable alloys normally being a modified nickel-based superalloy. When this charge melts, it causes a blanking plug at the bottom of the crucible to melt, and the complete charge of molten metal falls from the crucible into the mould 24. This mould is preheated by the heating elements 27 and the amount of metal in the crucible 23 is arranged to be just sufficient to fill the heated mould.

With the mould 24 full of molten metal the chill plate 25 operates on the base of the mould to initiate solidification of the metal, and at the same time the ram 26 operates to withdraw the mould slowly from the heated middle chamber 21. As is known in the art the direction of heat flow and the direction of progression of the solidification front are thus arranged to be unidirectional and as a result the grain structure of the casting is similarly unidirectional.

Figure 3:
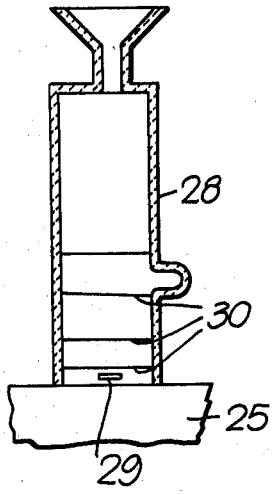
FIG. 3 is a section through a casting mould used in the apparatus of FIG. 2.

As so far described the apparatus will be suitable for the production of directionally solidified castings; in order to produce single crystal castings with pre-determined three-dimensional orientations, the mould must have special features. FIG. 3 shows one way in which the mould may be caused to produce one of the single crystals making up the blade of FIG. 1. In this case the mould 28 is provided, at its base adjacent the chill plate 25, with a seed crystal 29, of the alloy used. This seed crystal is held in the mould 28 in the orientation required for the corresponding final crystal.

In FIG. 3 is indicated at 30 the progressive advance of the solidification fronts of the single crystal growing from the seed crystal, and it will be seen that they finally grow to produce a complete single crystal 17. A similar method using different moulds may be used to product the crystals 18 and 19.

Figure 4:
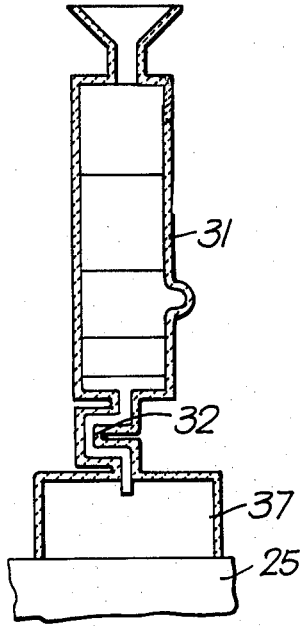
FIG. 4 is a section through an alternative to the mould of FIG. 3 and, FIG. 5 shows how a blade in accordance with the invention may be made up from separate single crystals.

FIG. 4 shows an alternative version of mould 31. In this case the mould is provided with a passage 32 which leads from the bottom of the mould and extends in a series of different directions, finally opening into a reservoir 37. The passage 32 has a number of right angled bends in it and as is known in the art if solidification of the molten metal is commenced at the base of the reservoir 37 the passages serve to favour the growth of one grain orientated in a predetermined direction. By suitably adjusting the shape and dimensions of the passage 32 it can be arranged that only a single grain of the required orientation are formed from one end of the passage and into the bulk of the casting.

It will be appreciated that the correct orientation may be achieved by the use of other means such as a plurality of angled chill plates as known in the art.

As an alternative to making the single crystals 17, 18 and 19 in separate casting operations it would be possible to use a single mould having the shape of the desired blade but split into the three sections by partitions. One crystal would grow in each of the sections and these crystals could be removed from the mould and subsequently joined.

Figure 5:
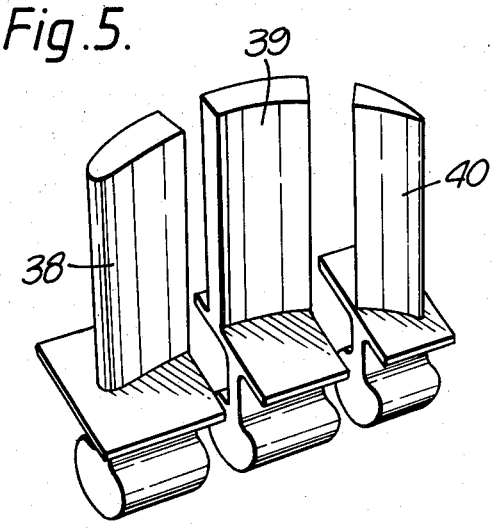

FIG. 5 illustrates the concept of joining the three crystals to produce a blade. Here separate pieces 38, 39 and 40 each comprise single crystals and when assembled together form the required blade shape. These separate pieces are made by one of the casting techniques described above and may be assembled together by diffusion bonding, brazing or other similar techniques.

In the embodiment described above the plurality of crystals making up the blade are formed separately and subsequently joined. As an alternative, all these crystals could be grown together as part of an integral casting. This could be done using moulds similar to those of FIGS. 3 and 4 but having the overall shape of the required final blade and three separate crystal initiating devices. Clearly it would be necessary to ensure that the boundary between the crystals, as the crystals grow, remains in a desired location throughout the span of the blade.

It should be noted that a number of other modifications may be made to the techniques described above. In particular, it is only necessary, to obtain the benefit of the invention, to make the aerofoil of the blade or vane in the multiple-single crystal manner. The remainder can be directionally solidified or equi-axed and could be made separately or formed integrally using a suitable casting technique. And as mentioned above, the technique is applicable to both compressor and turbine rotor and stator blades.

We claim:

1. A blade or vane for a gas turbine engine, the blade or vane having a cambered aerofoil portion comprising a plurality of single crystals of an alloy, each crystal extending longitudinally of the aerofoil and having a predetermined three-dimensional orientation different from that of the other crystals such that each such crystal has an optimum value of a chosen property in directions longitudinal and transverse of the aerofoil.

2. A blade or vane as claimed in claim 1 and in which said chosen property is Young's modulus.

3. A blade or vane as claimed in claim 2 and in which said optimum value is a minimum value.

4. A blade or vane as claimed in claim 1 and in which said direction transverse of the blade lies parallel with that part of the mid-chord line of the aerofoil passing through the crystal.

5. A blade or vane as claimed in claim 4 and in which said crystals are orientated with their <1, 0, 0> crystallographic axes directed longitudinally of the aerofoil and parallel with that part of the mid-chord line of the aerofoil passing through the crystal.

6. A blade or vane as claimed in claim 1 and in which said crystals are separately formed and joined together by a metallurgical bond to form the aerofoil.

7. A blade or vane as claimed in claim 1 and in which said aerofoil comprising said crystals is formed integrally in a single casting process.

8. A blade or vane as claimed in claim 1 and in which there are three said crystals.

9. A blade or vane as claimed in claim 1 and in which said alloy comprises a nickel-based superalloy.

10. A superalloy gas turbine engine blade or vane having a cambered aerofoil portion, said blade or vane composed of a plurality of single superalloy crystals, each crystal extending longitudinally of the aerofoil and having a predetermined three-dimensional orientation different from that of the other crystals, each single crystal oriented such that each crystal has in those directions (1) longitudinal of the aerofoil, and (2) transverse of the aerofoil, wherein the direction is substantially parallel with that part of the mid-chord line of the aerofoil passing through the crystal an optimum value of a predetermined property in both said directions.

11. A thermal stress-resistant superalloy gas turbine engine blade or vane having a cambered aerofoil portion, said blade or vane composed of a plurality of single superalloy crystals, each crystal extending longitudinally of the aerofoil and having a predetermined three-dimensional orientation different from that of the other crystals, each single crystal oriented such that each crystal exhibits a low Young's modulus value in those directions (1) longitudinal of the aerofoil, and (2) transverse of the aerofoil, wherein the direction is substantially parallel with that part of the mid-chord line of the aerofoil passing through the crystal.

* * * * *